US009373899B2

(12) United States Patent
Wu

(10) Patent No.: US 9,373,899 B2
(45) Date of Patent: Jun. 21, 2016

(54) BUTTERFLY SPRING CONNECTOR

(71) Applicant: Dinkle Enterprise Co., Ltd., New Taipei City (TW)

(72) Inventor: Shang-Tsai Wu, New Taipei City (TW)

(73) Assignee: DINKLE ENTERPRISE CO., LTD., New Taipei (TW)

( * ) Notice: Subject to any disclaimer, the term of this patent is extended or adjusted under 35 U.S.C. 154(b) by 0 days.

(21) Appl. No.: 14/587,175

(22) Filed: Dec. 31, 2014

(65) Prior Publication Data

US 2016/0072201 A1 Mar. 10, 2016

(30) Foreign Application Priority Data

Sep. 5, 2014 (TW) ..... 103130790 A

(51) Int. Cl.
*H01R 4/48* (2006.01)

(52) U.S. Cl.
CPC ..... *H01R 4/48* (2013.01); *H01R 4/4818* (2013.01)

(58) Field of Classification Search
CPC ... H01R 4/4818; H01R 4/4827; H01R 4/4836
See application file for complete search history.

(56) References Cited

U.S. PATENT DOCUMENTS 5,685,735 A * 11/1997 Hohorst ..... H01R 4/4836 439/441
6,336,824 B1 * 1/2002 Sorig ..... H01R 4/4836 439/395
6,851,967 B2 * 2/2005 Miyoshi ..... H01R 4/4836 439/441
8,251,738 B2 * 8/2012 Heckert ..... H01R 4/4836 439/441
8,485,841 B2 * 7/2013 Schrader ..... H01R 4/4827 439/441
8,771,004 B2 * 7/2014 Fehling ..... H01R 4/4818 439/441
2004/0248457 A1 * 12/2004 Walter ..... H01R 4/4836 439/441
2006/0063420 A1 * 3/2006 Reibke ..... H01R 4/4827 439/441
2006/0128206 A1 * 6/2006 Oesterhaus ..... H01R 4/4836 439/441
2007/0099479 A1 * 5/2007 Holterhoff ..... H01R 4/4836 439/441

* cited by examiner

*Primary Examiner* — Gary Paumen
(74) *Attorney, Agent, or Firm* — Bacon & Thomas, PLLC

(57) ABSTRACT

A butterfly spring connector made from a one-piece blank is disclosed. comprising a The butterfly spring connector includes:

a frame, comprising a first, second and third frame pieces defining a bottom plane;

a butterfly spring comprising the connection of an upper piece, a lower piece and a lateral piece, wherein the lateral piece extends from the first frame piece to a direction perpendicular to the bottom plane;

a support formed at the third frame piece to support the lower piece; and a clip piece formed at the second frame piece, to clip a wire or a cable in association with the upper piece.

The support and the clipping piece extend in the same direction of the lateral piece.

9 Claims, 3 Drawing Sheets

BUTTERFLY SPRING CONNECTOR

FIELD OF THE INVENTION

The present invention relates to a butterfly spring connector, especially to a butterfly spring connector formed from a one-piece blank.

BACKGROUND OF THE INVENTION

The butterfly spring connector is a component widely used in various electrical connectors or signal connectors.

A conventional butterfly spring connector typically includes a housing and a butterfly spring. A butterfly spring generally includes an upper piece and a lower piece in connection with the upper piece to form an acute angle. The Butterfly spring is installed inside the housing in any applicable manner, such that the lower piece is fixed to one side wall of the housing, while the free end of the upper piece abuts against the opposite side wall of the frame, or very close to the opposite side wall of the housing. Wire or cable is inserted from the side where connection of the upper piece and lower piece locates, entering into the space between the free end of the upper piece and the housing, whereby the wire or cable is firmly clamped by the upper piece and the opposite side wall of the frame body, due to the spring force of the butterfly spring. The butterfly spring and the housing, or at least the opposite side wall of the housing, is made of electrically conductive material. Therefore, when inserted the wire or cable is in electrical contact with the butterfly springs and/or the opposite side wall of the housing.

The housing is usually coupled to another connector pin or terminal, so to form connections with another terminal, wire or cable. The housing can also be electrically connected to an electrical or electronic circuit directly, in order to provide electrical power or electronic signal to the electrical or electronic circuit or circuits. When removing the wire or cable from the space between the upper piece and the housing, the usual way is to further compress the upper and lower pieces, to release the clamping force applied to the wire or cable by the upper piece. The easiest way to compress the butterfly is to insert, for example, a screwdrivers or a flat object into the space between the upper piece and the housing, while in most butterfly connector products a tongue stopper is moveably or pivotally provided to abut the upper piece, whereby the butterfly spring may be compressed by applying a force to the tongue stopper from external.

In order to adjust the clamping force and stability of the butterfly spring and to simplify the production of the butterfly connector, the industry has developed certain solutions to improve the butterfly spring connector. Most of the solutions provide improvements to the shape, length of the butterfly, its connections with the housing and the shape of the housing.

U.S. Patent Publication US 2011/0312228 (U.S. Pat. No. 8,485,841) discloses a butterfly spring for butterfly spring connector. The butterfly spring has an upper piece, a lower piece and a lateral piece. A tongue stopper is extended from a lateral side of the lateral piece, to engage in a corresponding hole provided at bottom of the housing. The housing provides a symmetric geometry, whereby two insert pins extend from opposite sides of the lower edge and a support is provided at the upper edge and the lower edge, respectively. Two openings are provided at the base portion of the two insert pins. When the butterfly spring is installed inside the housing, with the tongue stopper inserted into one of the openings, the two supports support the butterfly spring. The butterfly connector is in a two-piece design. Therefore, both its production and assembly are difficult.

U.S. Patent Publication US 2011/0207361 discloses a butterfly spring connector. Its housing forms a bottomless U shape frame. At the lower side of the U shape two connector pins extend outward to form a connector clip. Its butterfly spring has an upper piece and a lower piece. The lower piece is affixed and in contact with a side wall of the housing by a plastic frame, so to form electrical connection. The invention further uses the plastic frame to define the butterfly spring. The butterfly spring and the housing have a simple shape, while the connector is complicated in its structure. Manufacture and assembly for this butterfly spring connector are both costly.

U.S. Patent Publication US 2012/0108099 (U.S. Pat. No. 8,579,651) discloses a butterfly spring connector made from a one-piece blank. The butterfly spring has an upper piece, a lower piece and a lateral piece. The lateral piece is extended from a side wall of the housing. The free end of the upper piece forms contact with a central portion of the side wall. Two connector pins extend from the bottom side of the housing to form a connector clip. Wire or cable is inserted between the upper piece and its corresponding side wall. The butterfly spring connector provides a one-piece design, while its clamping force tends to weaken due to elastic fatigue, because the lateral piece extends directly from the side wall. According to its embodiments, to enhance its clamping force, a two-piece design is preferred.

U.S. Patent Publication US 2013/0189861 discloses a butterfly spring connector. The butterfly spring has an upper piece and a lower piece. A lateral piece is formed by a side wall of the housing. The free end of the upper piece abuts against a corresponding side wall of the housing. This side wall includes a plate made of another conductive material, engaged between the upper side and the bottom side of the housing. The butterfly spring connector provides excellent clamping force, while it is difficult to remove the wire or cable from the connector. In addition, its housing has a complex structure, which is difficult to fabricate.

U.S. Patent Publication US 2012/0295495 discloses a butterfly spring connector. The butterfly spring has an upper piece and a lower piece. A lateral piece is formed by a side wall of the housing. The free end of the upper piece abuts against a corresponding side wall of the housing. This side wall is formed by bending and extending the top side and bottom side of the housing. A connector piece is inserted between the upper piece and its corresponding side wall. Two connector pins extend from the connector piece to form a connector clip. The butterfly spring connector provides excellent clamping force, while it is difficult to remove the wire or cable from the connector. In addition, its housing and butterfly spring have a complex structure, which leads to waste of material in fabrication.

From the above description of the known arts, it is appreciated that developments in the design of butterfly spring connector are aimed at a butterfly spring connector that can be produced from a one-piece blank. The butterfly spring connector does not only provide a fine and stable clamping force but also allow a wire or cable be easily removed. Preferably, the butterfly spring connector further allows adjustments in its clamping force in accordance with needs in its applications. In addition, the butterfly spring connectors must be easy to fabricate, able to save materials and fabrication and assembly costs.

OBJECTIVES OF THE INVENTION

One objective of the present invention is to provide a novel structure for the butterfly spring connector. The butterfly spring connector may be made from a one-piece blank. The butterfly spring connector does not only provide a strong and stable clamping force but also the possibility of adjusting its clamping force in accordance with purposes of its application. In addition, the objective of this invention is also to provide a butterfly spring connector that is easy to fabricate and saves materials and fabrication and assembly costs.

According to this invention, a butterfly spring connector is provided and comprises a one-piece element that comprises: a frame comprising a first frame piece and second and third frame pieces respectively connected to each end of the first frame piece; the first, second and third frame pieces defining a bottom plane; a butterfly spring comprising an upper piece, a lower piece and a lateral piece, wherein the upper piece and the lower piece connect to form an acute angle, the lower piece and the lateral piece connect to form an angle and the lateral piece extends to a direction perpendicular to the bottom plane and connects the first frame piece with at least a partial edge of the lateral piece; a support formed at the third frame piece to support the lower piece of the butterfly spring, when the upper piece of the butterfly spring deforms due to an external force; and a clip piece formed at the second frame piece, to clip a wire or a cable in association with the upper piece of the butterfly spring; wherein the support and the clipping piece extend in the same direction of extension of the lateral piece from the bottom plane.

In a preferred embodiment of the invention, the frame further includes a plate disposed at the bottom plane defined by the first, second and third frame pieces. In another preferred embodiment of the present invention, an opening is formed at the second frame piece at a position corresponding to an end of the upper piece. The upper and/or lower pieces may further include bent projections towards an internal or external of the angle formed by the upper and lower pieces. Length of connection of the lateral piece and the first frame piece or its ratio to the length of the lateral piece may be adjusted, to modulate the stiffness of the butterfly spring. According to an embodiment of the invention, the butterfly spring connector is formed using a narrow metal plate by pressing.

In other embodiments of the invention, one or more pins to function as connector pins may extend from any of the frame pieces. In other embodiments, the butterfly spring connector may further include a contact piece, which extends to form a connector clip with two connector pins. The main body of the contact piece may be plugged into the space between the upper piece of the butterfly spring and the second frame piece.

These and other objectives and advantages of this invention may be clearly understood from the following detailed description by referring to the following drawings. The drawings illustrate several examples of the butterfly spring connector of this invention, without the intention of limiting the scope of this invention.

Detailed description to several preferred embodiments of this invention will be given below. It is however appreciated that the detailed description serves only for illustration of certain aspects of this invention, without limitation to the scope of protection.

Figure 1:
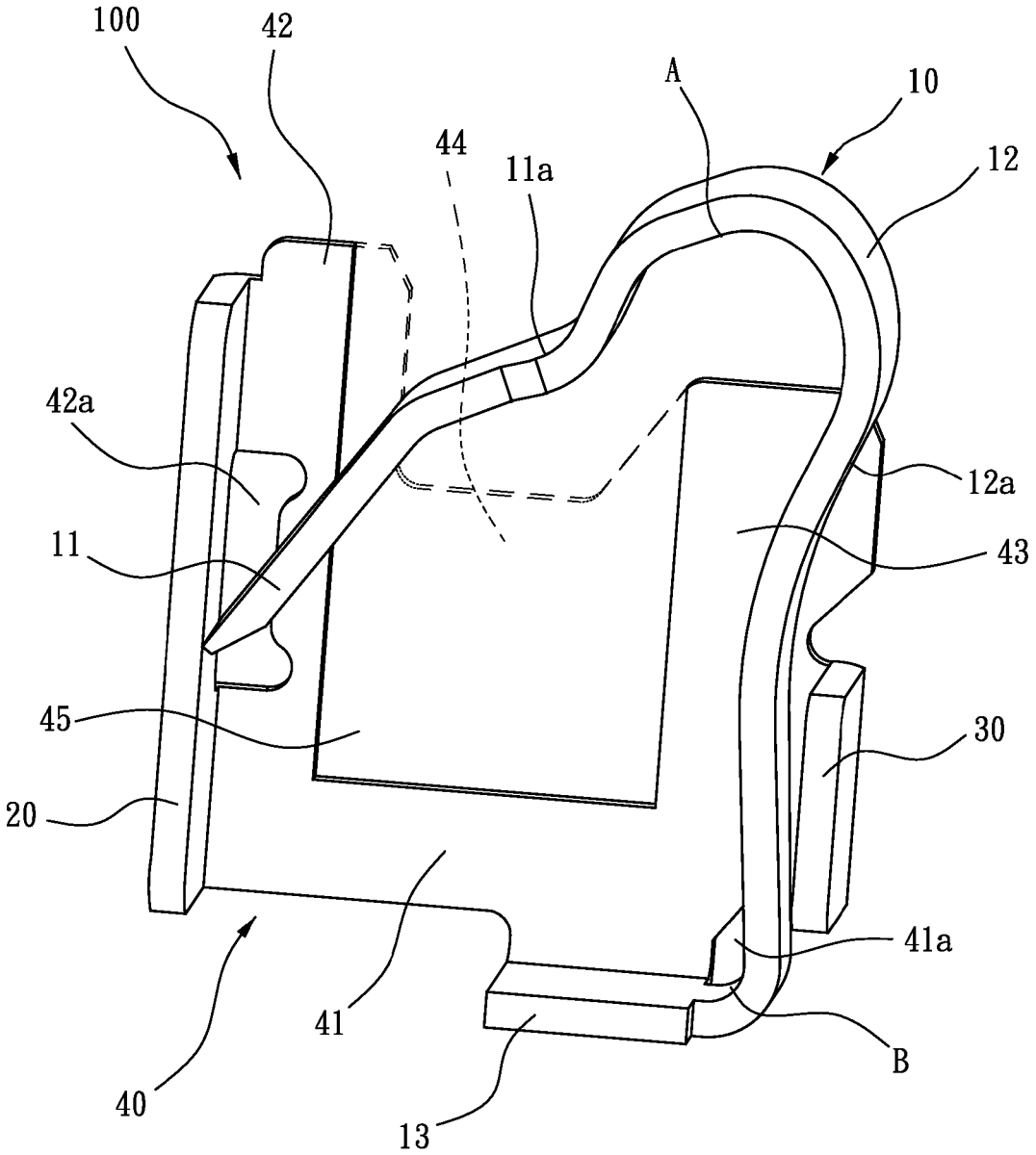
FIG. 1 shows the lateral view of one example of the butterfly spring connector of this invention.

FIG. 1 shows the lateral view of one example of the butterfly spring connector of this invention. As shown in this figure, in this example the butterfly spring connector 100 is a butterfly spring connector formed from a one-piece blank.

In the preferred embodiments of this invention, the butterfly spring connector 100 is formed from a piece of conductive material, such as a metal plate, by pressing or other formation methods. The butterfly spring connector 100 includes a butterfly spring 10, a clamp piece 20 and a support 30, all formed in one piece on a frame 40. In the example of FIG. 1, the frame 40 includes a first frame piece 41, second and third frame pieces 42, 43 respectively connected to each end of the first frame piece 41. The frame 40 may further include a fourth frame piece (not shown) connected to the free ends of the second and third frame pieces 42, 43. The frame 40 may also include more than one frame piece, in addition to the first, second and third frame pieces, and a bottom plate 44 in connection with the first, second and third frame pieces 41, 42, 43. However, the bottom plate 44 is not a necessary element. The frame 40 supports the butterfly spring 10, the clamp piece 20 and the support 30. If a bottom plate 44 is provided, the butterfly spring connector 100 would be stiffer and the bottom plate 44 may function as shield for EMI. In the structure of the invented butterfly spring connector 100 the frame 40 includes at least 3 frame pieces, which may connect with one another or divided by other frame pieces. The 3 frame pieces 41, 42, 43 define a plane, referred to as bottom plane 45 in this invention. If the frame 40 includes the bottom plate 44, the plane where the bottom plate 44 is disposed is the bottom plane 45.

As shown in FIG. 1, the butterfly spring 10 includes an upper piece 11, a lower piece 12 and a lateral piece 13. The upper piece 11 and the lower piece 12 connect to form an acute angle A, while the lower piece 12 and the lateral piece 13 connect to form an angle B. In this example, a partial edge of the lateral piece 13 connects the first frame piece 41, such that the plane where the lateral piece 13 locates is perpendicular to the bottom plane 45. In other words, the lateral piece, as well as the upper piece 11 and the lower piece 12, is formed by bending the metal plate at the first frame piece 41.

In addition to the butterfly spring 10, the support 30 is connected to the third frame piece 43 and extends from the third frame piece 43 in a direction perpendicular to the bottom plane 45. In the preferred embodiments of this invention, the support 30 is formed by bending the metal plate at the third frame piece 43, such that it extends in the same direction of extension of the lateral piece 13 from the first frame piece 41. When the upper piece 11 of the butterfly spring 10 bends due to an external force applied downwards to the upper piece 11, the lower piece 12 may abut against the support 30. The clamp piece 20 on the other hand is in connection with the second frame piece 42 and extends from the second frame piece 42 in the same direction of extension of the support 30, so to clamp an object from external in association with the upper piece 11 of the butterfly spring 10, see FIG. 3. Also as shown in FIG. 1, the direction of extension of the support 30 and the clamp piece 20 is substantially the same as the direction of extension of the lateral piece 13 from the first frame piece 41. Such a structure enables the support 30 to support the lower piece 12 of the butterfly spring 10 and the clamp piece 20 to clamp an introduced piece, such as a wire or a cable, in association with the upper piece 11 of the butterfly spring 10.

In the embodiments of this invention, the butterfly spring 10 may further include bent projections 11*a*, 12*a* in the upper piece 11 and/or lower piece 12, so to adjust the stiffness or the clamping force of the butterfly spring 10. The bent projections 11*a*, 12*a* may protrude toward the external or internal of the angle formed by the upper piece 11 and the lower piece 12. Number of the bent projections 11*a*, 12*a* is not limited to one in each of the elastic pieces 11, 12.

An opening 42*a* is formed at the second frame piece 42, at a position corresponding to the free end of the upper piece 11. The opening 42*a* provides elastic forces to the clamp piece 20, in relation to the upper piece 11. The position, length and/or width, and the ratio of its length to the length of the second frame piece 42 or the clamp piece 20, are used to adjust the elastic forces of the clamp piece 20 in relation to the upper piece 11, i.e., the clamping force of the clamp piece 20 and the upper piece 11 to the wire or cable. In addition, the length of the connection between the lateral piece 13 and the first frame piece 41 is adjustable, so to adjust the stiffness of the butterfly spring 10, i.e., the clamping force applied to the wire or cable by the clamp piece 20 and the upper piece 11. If the lateral piece 13 is not connected to the first frame piece 41 with its full length, a slot, such as that with reference number 41*a* in FIG. 1, would be formed between the lateral piece 13 and the first frame piece 41. By properly adjusting the shape, size of the opening 42*a* and/or the slot 41*a*, it is possible to fabricate butterfly spring connectors with a variety of clamping force, in order to fulfill different needs in application.

When a wire or a cable is inserted downwardly, as shown in FIG. 1, to the space between the clamp piece 20 and the upper piece 11, the butterfly spring 10 deforms due to this external force, such that the lower piece 12 abuts the clamp piece 20 at the third frame piece 43. The support 30 provides supporting forces to strengthen the elastic force of the butterfly spring 10. However, because in the butterfly spring 10 the lateral piece 13 connects the frame 40 at the first frame piece 41. When removing the wire or cable from the butterfly spring 10, only relatively small force is needed. For example, by inserting a screw driver into the space between the wire/cable and the upper piece 11, the wire/cable may be easily removed. Compared with the conventional art, in this invention the force necessary in removing the wire/cable is lighter. The elastic force of the butterfly spring 10 may be further adjusted by modulating the shape or size of the slot 41*a*.

The support force of the support 30 strengthens the clamping force of the upper piece 11 to the wire or cable. This clamping force may be further adjusted by modulating the shape or size of the opening 42*a*.

In some embodiments of this invention, the support 30 may be provided in the internal of the angle formed by the upper and lower pieces 11, 12 and extended from the bottom plate 44. In addition, in some particular example, a tongue stopper (not shown) may further be provided in the internal of the angle formed by the upper and lower pieces 11, 12, to limit the movement of the upper piece 11. Similarly, the tongue stopper may extend from the bottom plate 44.

Figure 2:
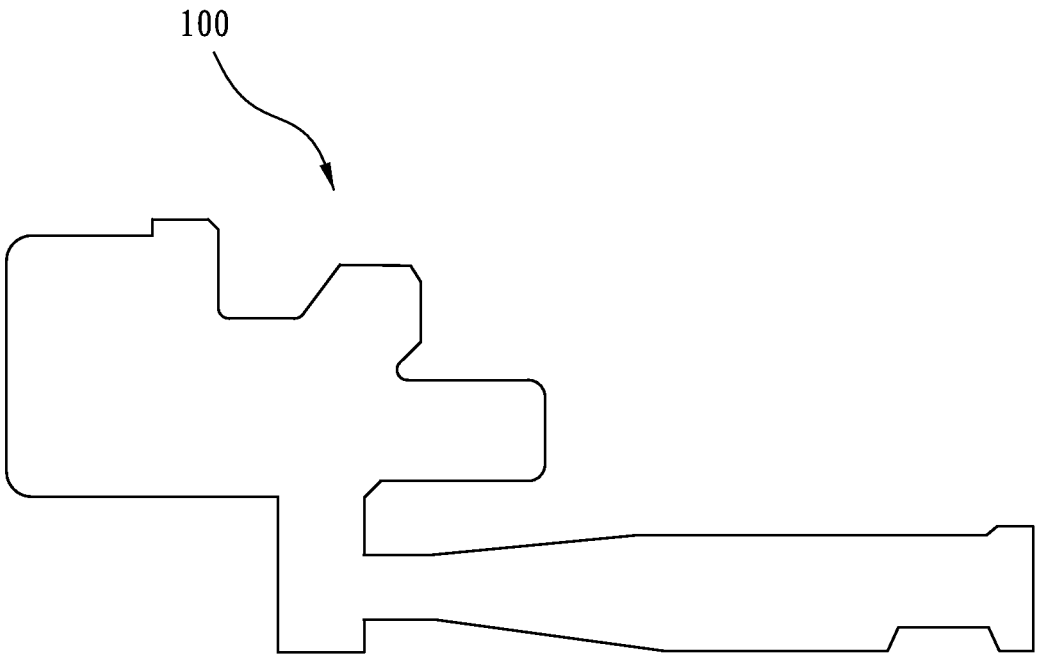
FIG. 2 is the plan view of the butterfly spring connector of FIG. 1, before it is bent to form the butterfly spring connector.

According to one example of this invention, the butterfly spring connector 100 may be formed by pressing a narrow metal plate step by step. FIG. 2 shows the plan view of a material that may be used to form the butterfly spring connector 100 of this invention, before it is processed. As shown in this figure, the material is a narrow metal piece and may be processed by pressing the material step by step continuously, to form the butterfly spring connector 100 of this invention. This example provides the possibility of arranging a plurality of butterfly spring connectors densely. Fabrication process is thus simplified and fabrication costs are also reduced.

Figure 3:
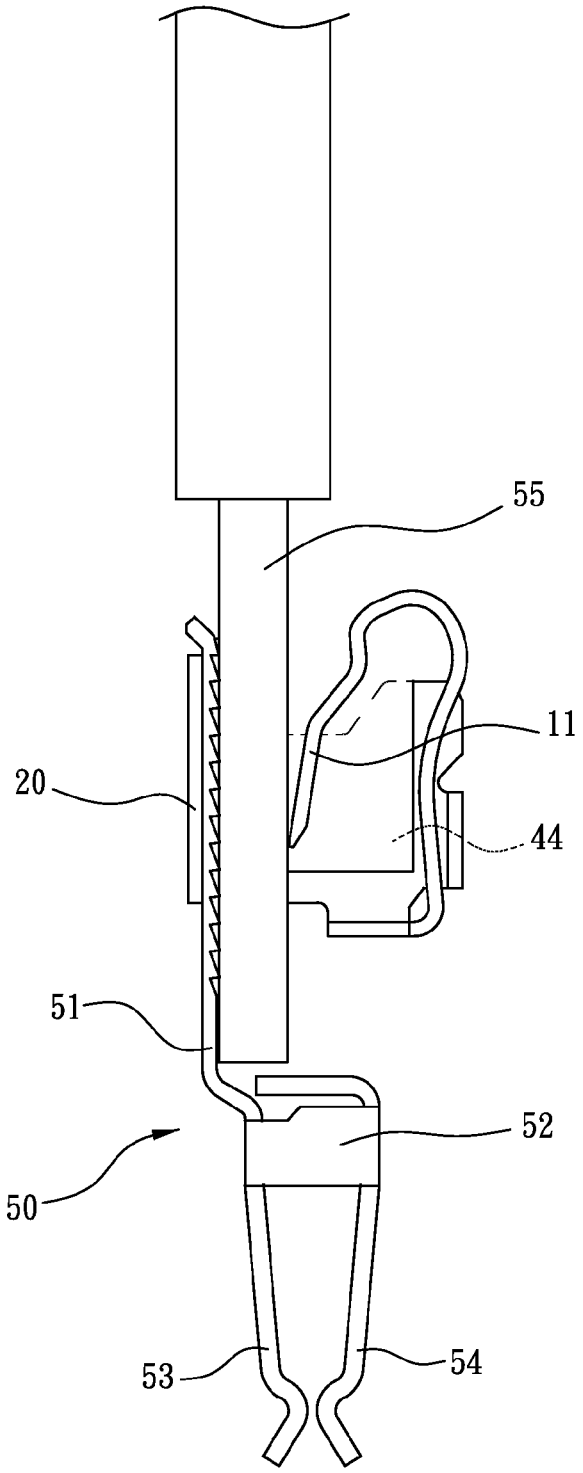
FIG. 3 shows an example of the assembly of one embodiment of the invented butterfly spring connector and a contact piece.

In other examples of this invention, one or more connector pin may extend from any frame pieces of the frame 40. The connector pins may be disposed at any of frame pieces 41, 42, 43, or any other frame pieces and extend from the relative frame piece. In other examples, the butterfly spring connector 100 may further include a contact piece 50, as shown in FIG. 3. As shown in FIG. 3, the contact piece 50 includes a longitudinal piece 51, as its main body to be inserted into the space between the upper piece 11 and the clamp piece 20, so to clamp the wire or cable 55 in association with the upper piece 11. The longitudinal piece 51 of the contact piece 50 extends from a connection portion 52, which extends in an opposite direction to form two elastic pins 53, 54, to function as connector pins. In the example of FIG. 3, the contact piece 50 and the butterfly spring connector 100 are separate elements. However, this design saves material costs, if compared with the conventional design wherein the connector pins extend from the frame 40 directly, as described above.

Material to form the frame 40 and the butterfly spring 10, and even the extended connector pins, may be any electrically conductive material. Generally speaking, materials suited in the fabrication of the invented butterfly spring connector include any material that is stiff, sufficient to provide necessary clamping forces. Suited materials include stainless steel and stainless steel with suitable metal coating. Other material with relative softness, such as copper, copper alloys, copper or copper alloys coated with noble metals or other metal, are also useful in this invention. As to the contact piece, it is preferable to use relatively soft materials, such as copper, copper alloys, copper or copper alloys coated with noble metals or other metal. It is appreciated that the material used in the butterfly spring connector of this invention is not any technical limitation of this invention.

EFFECTS OF THIS INVENTION

The butterfly spring connector as described above has provided a novel structure of the butterfly spring connector. The butterfly spring connector may be made from a one-piece blank, with lower material costs. The invented butterfly spring connector does not only provide fine and stable clamping force, the clamping force is adjustable. This invention has provided a butterfly spring connector that is easy to fabricate and low in material and fabrication and assembly costs.

What is claimed is:

1. A butterfly spring connector, comprising:

a one-piece element that includes a frame, a butterfly spring, a support, and a clamp section all integrally formed from the same piece of metal:

said frame comprising a first frame section and second and third frame sections respectively connected to each end of the first frame section; the first, second and third frame sections defining a bottom plane;

said butterfly spring comprising an upper section, a lower section and a lateral section, wherein the upper section and the lower section connect to form an acute angle, the lower section and the lateral section connect to form an angle, and the lateral section extends in a direction perpendicular to the bottom plane and includes at least a partial edge connected to the first frame section;

said support formed at the third frame section to support the lower section of the butterfly spring when the upper section of the butterfly spring deforms due to an external force; and said clamp section formed at the second frame section, to clamp a wire or a cable in association with the upper piece of the butterfly spring;

wherein the support and the clamp section extend in the same perpendicular direction of extension from the bottom plane as the lateral section.

2. The butterfly spring connector of claim 1, wherein the frame further includes a plate disposed at the bottom plane defined by the first, second and third frame sections.

3. The butterfly spring connector of claim 1, wherein an opening is formed at the second frame section at a position corresponding to an end of the upper section.

4. The butterfly spring connector of claim 1, wherein the upper or lower section of the butterfly spring further comprises at least one bent projection towards an interior of the angle formed by the upper and lower sections.

5. The butterfly spring connector of claim 1, wherein the upper or lower section of the butterfly spring further comprises at least one bent projection extending towards an exterior of the angle formed by the upper and lower sections.

6. The butterfly spring connector of claim 1, wherein a slot is formed at connection of the lateral section and the first frame section, to adjust a stiffness of the butterfly spring.

7. The butterfly spring connector of claim 1, further comprising at least one connector pin extended from one of the frame sections.

8. The butterfly spring connector of claim 1, wherein the butterfly spring connector is formed by a metal plate.

9. The butterfly spring connector of claim 1, further comprising a contact piece extended to form a connector clip with two connector pins, a main body of the contact piece being plugged into the space between the upper section of the butterfly spring and the second frame section.

* * * * *